US006453998B1

(12) United States Patent
Reeve

(10) Patent No.: US 6,453,998 B1
(45) Date of Patent: Sep. 24, 2002

(54) PROGRESSIVE LOCK INTEGRAL JOINT CENTRALIZER

(76) Inventor: Robert W. M. Reeve, 700 Troll View Dr., Grants Pass, OR (US) 97527

( * ) Notice: Subject to any disclaimer, the term of this patent is extended or adjusted under 35 U.S.C. 154(b) by 0 days.

(21) Appl. No.: 09/703,236

(22) Filed: Oct. 31, 2000

(51) Int. Cl.[7] ..... E21B 17/10
(52) U.S. Cl. ..... 166/241.1; 166/241.6
(58) Field of Search ..... 166/241.1, 241.6, 166/134; 175/325.1, 325.2

(56) References Cited

U.S. PATENT DOCUMENTS

| | | | | |
|---|---|---|---|---|
| 3,978,924 A | | 9/1976 | Roesner | 166/241 |
| 4,407,377 A | * | 10/1983 | Russell | |
| 4,425,966 A | | 1/1984 | Garney | 166/241 |
| 4,776,394 A | * | 10/1988 | Lynde et al. | |
| 4,787,458 A | | 11/1988 | Langer | 166/380 |
| 4,830,105 A | | 5/1989 | Petermann | 166/241 |
| H1192 H | * | 6/1993 | Keller | |
| 5,358,040 A | | 10/1994 | Kinley et al. | 166/241.3 |
| 5,566,754 A | | 10/1996 | Stokka | 166/241.6 |
| 5,575,333 A | | 11/1996 | Lirette et al. | 166/241.1 |
| 5,655,609 A | * | 8/1997 | Brown et al. | |
| 5,758,723 A | | 6/1998 | Saucier et al. | 166/55.8 |
| 5,785,125 A | | 7/1998 | Royer | 166/380 |
| 5,881,810 A | | 3/1999 | Reinholdt et al. | 166/241.7 |
| 5,934,378 A | | 8/1999 | Tchakarov | 166/381 |
| 5,979,550 A | * | 11/1999 | Tessier | |
| 5,992,525 A | | 11/1999 | Williamson et al. | 166/313 |
| 6,209,638 B1 | * | 4/2001 | Mikolajczyk | |
| 6,237,687 B1 | * | 5/2001 | Barbee, Jr. et al. | |

* cited by examiner

*Primary Examiner*—David Bagnell
*Assistant Examiner*—Brian Halford
(74) *Attorney, Agent, or Firm*—Conley, Rose & Tayon, P.C.

(57) ABSTRACT

The present invention relates to a centralizer for use downhole in a well. The centralizer body has one or more contact arms attached to a movable collar. The body is run into the well to a selected depth within the well and the collar is moved to move the contact arms radially outwardly from the body. The collar can be moved sequentially with hydraulic fluid pressure to control the contact arm movement. The contact arm movement can also be locked to retain the centralizer radial force within the well.

17 Claims, 2 Drawing Sheets

PROGRESSIVE LOCK INTEGRAL JOINT CENTRALIZER

BACKGROUND OF THE INVENTION

The present invention relates to the field of centralizers used downhole in wells. More particularly, the invention relates to an integral joint centralizer for incrementally increasing the radial force exerted by a movable centralizer element.

Conventional centralizers provide standoff in a wellbore or casing string to centralize tubulars or tools or to facilitate even distribution of cement around the tubular. Numerous centralizers have been developed to provide different functions downhole in a well.

One type of centralizer is a solid body centralizer. One example of a conventional solid body centralizer is illustrated in U.S. Pat. No. 5,881,810 to Reinholdt et al. (1999). Solid body centralizers provide standoff and cement distribution properties but can be difficult to install in lengthy horizontal and slanted wells.

Another type of centralizer is a bow spring centralizer. Bow spring centralizers are often used instead of solid body centralizers because bow spring centralizers provide characteristics not possible with solid body centralizers. Bow spring centralizers have flexible bow spring arms that provide a spring force extending radially outwardly from the centralizer body. The bow springs are sufficiently flexible to facilitate travel of the centralizer through the well to the selected downhole elevation. To navigate constrictions in wells without binding the tool string, certain bow springs leave one spring end unattached to provide for compression of the bow spring through the constriction. The radial spring force provided by such bow springs is inherently limited by the need to provide for such flexural movement during installation.

Other spring configurations such as coiled springs have been used to urge centralizer arms against pipe casing. U.S. Pat. No. 3,978,924 to Roesner (1976) discloses a borehole instrument having pad assemblies attached to bow springs. U.S. Pat. No. 4,425,966 to Gamey (1984) discloses a tool having centralizing contact arms lockable in non-rotational positions to prevent translation along the tool shaft. U.S. Pat. No. 4,830,105 to Petermann (1989) discloses a centralizer having a tension coil spring for providing radial biasing forces. U.S. Pat. No. 5,358,040 to Kinley et al. (1994) discloses a mechanical arm centralizer for movement through restricted well pipe. U.S. Pat. No. 5,785,125 to Royer (1998) discloses arm support sleeves outwardly biased with springs.

Other techniques have also been developed to vary the holding forces provided by centralizers. U.S. Pat. No. 4,787,458 to Langer (1988) discloses a system for increasing the restoring force exerted by a bow spring against a casing or borehole wall. Protrusions on each bow spring increase the spring force while permitting sufficient flexure through wellbore constrictions. U.S. Pat. No. 5,934,378 to Tchakarov (1999) discloses a downhole drilling tool having upper and lower fingers operated by upper and lower actuators for engaging the fingers with the borehole wall.

The need for centralizers is particularly important in horizontal wellbores where the weight of tools and tubulars must be supported above the lower borehole wall. Special systems such as that disclosed in U.S. Pat. No. 5,992,525 to Williamson et al. (1999) have been developed to facilitate tool string deployment in horizontal and slanted wells.

Various systems have also been developed to deactivate centralizers. U.S. Pat. No. 5,566,754 to Stokka (1996) discloses a centralizer having rigid members collapsible under a lateral load of twenty tons. Tubular fluid pressure has also been used to deactivate centralizers as disclosed in U.S. Pat. No. 5,758,723 to Saucier et al. (1998), wherein a centralizer having arms in the normally extended position is deactivated by movement of a fluid pressure activated piston.

U.S. Pat. No. 5,575,333 to Lirette et al. (1996) discloses another type of spring bow unloading system wherein one end of each spring bow is attached to a centralizer body and the other end of each spring bow is attached to a floating collar. Radial compression of the spring bows due to a wellbore constriction causes movement of the floating collar without increasing the restoring force provided by the spring bows.

Conventional centralizer designs do not, however, permit control over the expandability provided by the centralizer arms. Accordingly, a need exists for an improved centralizer capable of deployment through well constrictions while providing downhole expandability with controllable radial force capabilities.

SUMMARY OF THE PREFERRED EMBODIMENTS

The preferred embodiment provides a centralizer for use downhole in a well. The centralizer comprises a body movable into the well, a contact arm having a first end stationary relative to the body and having a second end, wherein the contact arm is movable in a direction radially outwardly from the body, and a collar engaged with the contact arm second end, wherein the collar is selectively movable relative to the body to move the contact arm radially outwardly from the body. The collar is preferably movable by selected pressurization of a fluid within the well but may be controlled by other sufficient means. A lock also retains the contact arm in selected orientations relative to the body to maintain the centralizer radial force as the collar moves. Alternatively, the centralizer may not include the lock at all.

In different embodiments of the invention, the collar can be movable axially relative to said body in a direction toward said contact arm first end, the collar can be movable by selected pressurization of a fluid within the well, and a lock can retain the contact arm in selected orientations relative to the body to maintain the centralizer holding force.

DESCRIPTION OF THE PREFERRED EMBODIMENTS

Figure 1:
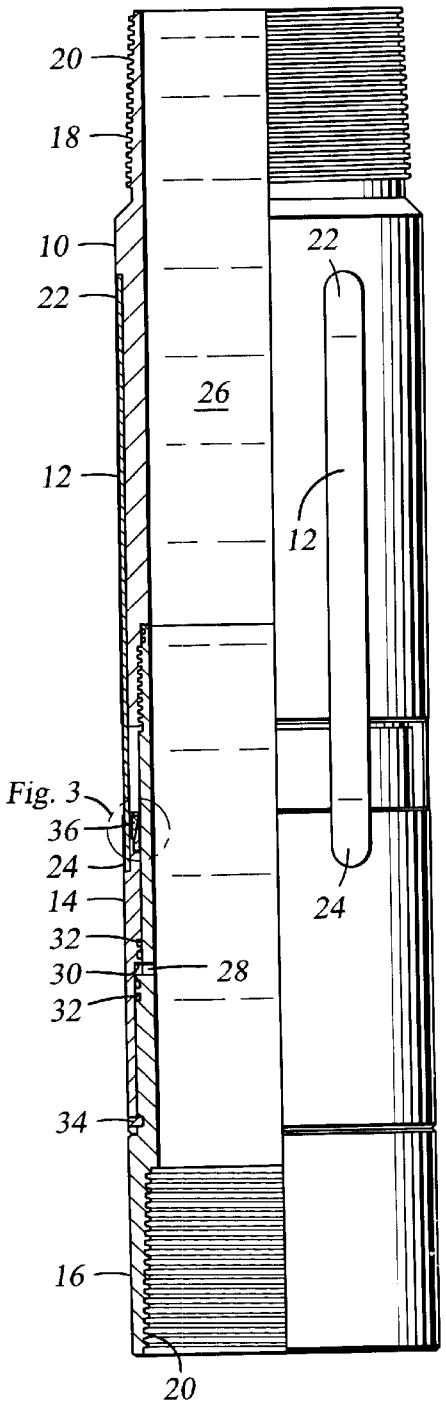
FIG. 1 illustrates a sectional view of a progressive lock integral joint centralizer constructed in accordance with the preferred embodiment.

The preferred embodiment comprises a centralizer with controlled expandability and radial force characteristics. FIG. 1 illustrates a progressive lock integral joint centralizer constructed in accordance with the preferred embodiment. The centralizer generally comprises body 10, one or more contact arms 12, and movable collar 14. Body 10 is formed with pin end 16 and box end 18 with both having threadforms 20 for rotational engagement therebetween and with well tubulars (not shown). Although body 10 is shown in two pieces 16, 18 and as an integral component connectable to a drill string, production casing, or other type of tubular string, body 10 can also comprise a single integral component or could have a radial diameter greater than or less than the connected tubular string.

Each contact arm 12 has a first end 22 stationary relative to body 10 and second end 24 movable relative to body 10. Although first end 22 is illustrated as stationary or attached to body 10, first end 22 can move relative to body 10 in different embodiments. Second end 24 is engaged with collar 14 for movement of contact arm 12 radially outwardly from body 10. Movement of collar 14 thus causes a corresponding movement of contact arm 12 in the radial direction. Movement can also be in rotational or other directions. The engagement between collar 14 and second end 24 comprises a rigid attachment such as by welding or integral construction, or can comprise a loose contact fit wherein collar 14 rests against second end 24.

Figure 2:
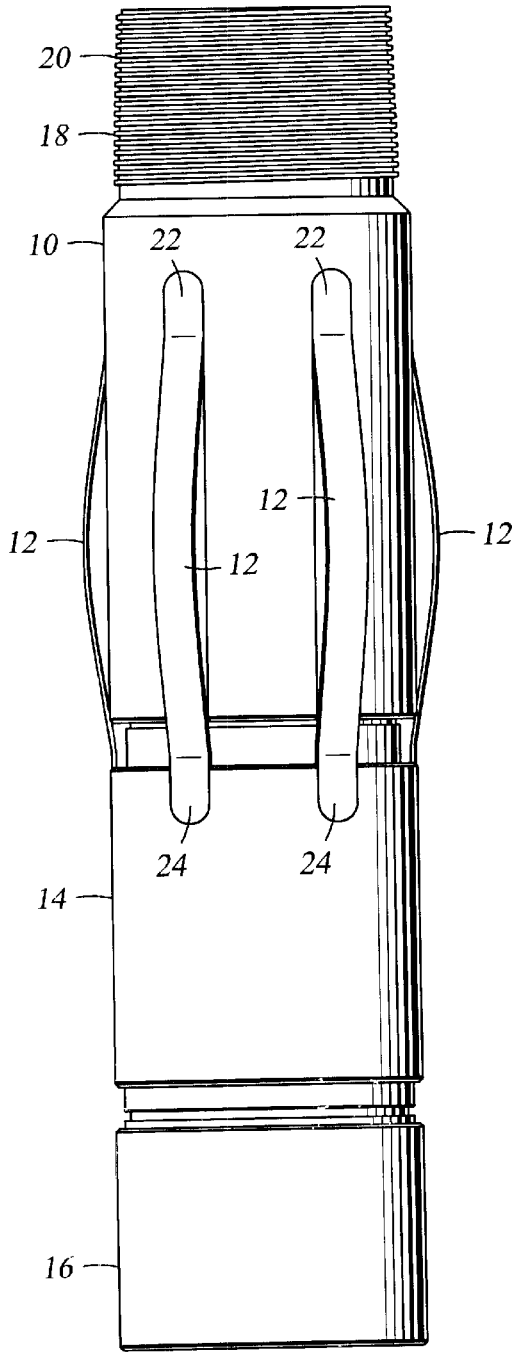
FIG. 2 illustrates a front elevation view of a progressive lock integral joint centralizer constructed in accordance with the preferred embodiment with expanded contact arms.

Collar 14 is shown as a ring positioned about cylindrical body 10 and is movable relative to body 10. If desired, collar 14 can rotate relative to body 10, but is configured in the embodiment illustrated as being movable axially relative to body 10. As collar 14 moves axially toward contact arm first end 22, contact arm 12 deforms as shown in FIG. 2 to move relative to body 10. The desired movement is in a radial direction relative to body 10 so that the overall diameter of the centralizer is increased to contact casing pipe or a borehole wall (not shown). Axial movement of collar 14 is thus converted to radial movement of contact arm 12. The radial force exerted by each contact arm 12 depends on the length of movement by collar 14, and thus control over such movement selectively controls the radial force exerted.

Collar 14 can be moved in many different ways, including operation by mechanical mechanisms, manipulation of the tubular string, electrical actuation, or fluid pressure devices. FIG. 1 illustrates a preferred embodiment wherein collar 14 forms a differential piston operable by pressure increases of fluid 26 within the interior of body 10. As the pressure of fluid 26 increases through known pumping techniques, such as by dropping a bottom plug into the tubular to land on a float collar (not shown), fluid pressure enters aperture 28 and contacts piston surface 30 of collar 14. Such contact drives collar 14 axially toward contact arm first end 22 and moves contact arm 12 radially outwardly as earlier described. Fluid 26 is contained with seals 32 during such movement. Although conventional bow springs can provide a radial force up to two thousand pounds force per bow spring, tests of the present device demonstrated superior results of up to eight thousand pounds per bow spring, or a total of forty-eight thousand pounds force in a centralizer having six contact arms 12. These extraordinary results provide gripping strength not obtainable with conventional bow spring centralizers. Shear pin 34 can prevent relative movement between collar 14 and body 10 until fluid 26 pressure reaches a selected level.

Figure 3:
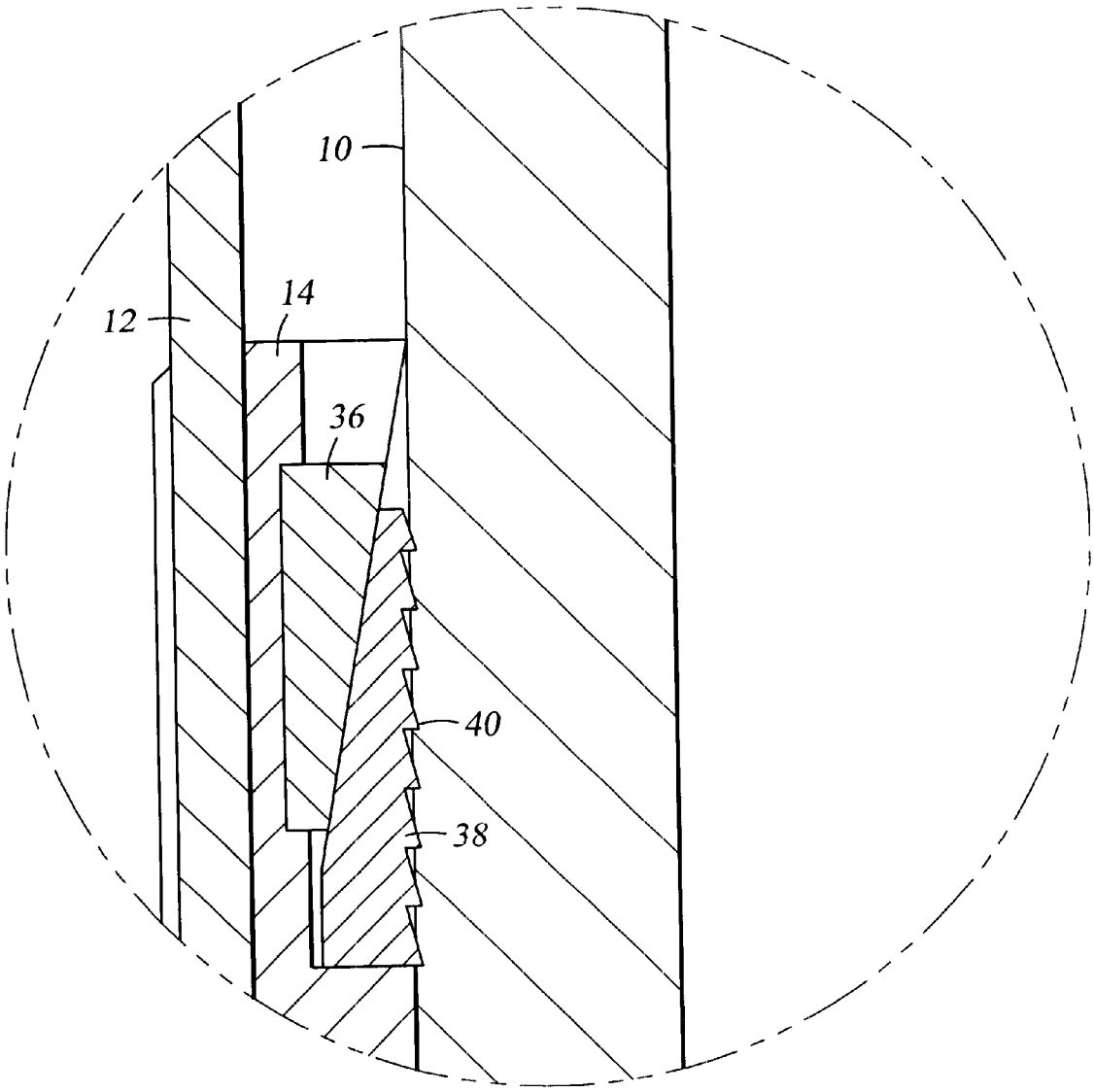
FIG. 3 illustrates a cross-sectional view of a lock mechanism constructed in accordance with the preferred embodiment.

To prevent loss in radial expansion due to a reduction in fluid 26 pressure, lock 36 prevents reverse movement of collar 14 and retains contact arm 12 in the radially expanded position as illustrated in FIG. 3. Lock 36 can comprise many different configurations and mechanisms suitable to prevent such reversal, and is shown in FIG. 3 as comprising wedge 38 having teeth 40 that engage the body 10 upon travel of the wedge 38 in the reverse direction. As the teeth 40 dig into the body 10, the teeth 40 prevent movement of the lock 36 and the collar 14 in the reverse direction. Lock 36 thus retains contact arm 12 in a selected orientation following radial outward movement of contact arm 12. Lock 36 is also capable of retaining contact arm 12 in different orientations radially outwardly from body 10 and is capable of sequential operation to retain contact arm 12 in orientations successively further radially outward from body 10. Depending upon the pressurization of fluid 26 of the configuration of lock 26, contact arm 12 can thus be expanded radially outwardly and retained at different positions to control the radial force exerted by contact arm 12.

Although contact arm 12 is illustrated as a flexible component, the arm can also be rigid and substantially inflexible in different embodiments. Collar 14 is illustrated as a cylindrical element but can also be formed in many different configurations and shapes operable in many different ways. Although other setting mechanisms can be used with contact arm 12 to accomplish the desired functions, hydraulically pressured fluid provides the benefit of high force setting levels while providing supervisory control and confirmation over the desired setting combinations, and provides for incremental setting capability under differing well diameter conditions at different locations within the wellbore. For example, the tool permits positive standoff even where a wellbore has washed out due to loose or unconsolidated geologic conditions where the washout diameter is equal to, or less than, the fully extended outside diameter of the contact arms.

The preferred and alternative embodiments can be run as a tool overlying a tubular string, but they are particularly suited to integral joint applications where the tool is integrated within the pipe string with a radial diameter equal to or less than the radial diameter of the tubular string. The contact arms are normally relaxed, which reduces the possibility of damage to seals or becoming stuck, entangled, or hung-up in subsea wellheads. The centralizer can thus be run in close tolerance conditions such as with close tolerance casing liners while still providing the ability to achieve maximum standoff in holes drilled with bi-center bits or that are washed out or underreamed. The unique setting and locking capabilities maintain the setting force provided by the hydraulic action of the fluid setting pressure and provide extremely high restoring force substantially equal to or greater than the force provided by a positive stand-off centralizer. Because the contact arms are normally relaxed at all times prior to setting, casing pipe and other tubulars can be rotated or otherwise manipulated prior to setting the centralizer. This manipulation feature is particularly important in preventing tubulars from becoming trapped within the wellbore or subsea wellheads.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A centralizer for use downhole in a well, comprising:

a body movable into the well;

a contact arm having a first end stationary relative to said body and having a second end, wherein said contact arm is movable in a direction radially outwardly from said body; and a collar engaged with said arm second end, wherein said collar is selectively movable relative to said body to move said contact arm radially outwardly from said body.

2. A centralizer as recited in claim 1, further comprising at least two contact arms.

3. A centralizer as recited in claim 1, wherein said contact arm is flexible to permit movement radially outwardly from said body.

4. A centralizer as recited in claim 1, wherein said collar is movable toward said contact arm first end to move said contact arm in a direction radially outwardly from said body.

5. A centralizer as recited in claim 1, wherein said collar is movable by operation of a pressurized fluid within said body.

6. A centralizer as recited in claim 5, wherein said collar includes a differential piston for operation in response to pressure changes in the pressurized fluid.

7. A centralizer as recited in claim 1, further comprising a lock for retaining said contact arm in a selected orientation following radial outward movement of said contact arm.

8. A centralizer as recited in claim 7, wherein said lock is capable of retaining said contact arm in different orientations radially outwardly from said body.

9. A centralizer as recited in claim 7, wherein said lock is capable of sequential operation retain said contact arm in orientations successively further radially outward from said body.

10. A centralizer as recited in claim 1, wherein said collar is axially moveable relative to said body to move said contact arm radially outwardly from said body.

11. A centralizer for use downhole in a well, comprising:

a body movable into the well;

a flexible contact arm having a first end stationary relative to said body and having a second end, wherein said contact arm is movable in a direction radially outwardly from said body; and a collar engaged with said arm second end, wherein said collar is axially movable relative to said body and toward said contact arm first end to move said contact arm radially outwardly from said body.

12. A centralizer as recited in claim 11, further comprising at least two contact arms.

13. A centralizer as recited in claim 11, wherein said collar is movable by operation of a pressurized fluid within said body.

14. A centralizer as recited in claim 13, wherein said collar includes a differential piston for operation in response to pressure changes in the pressurized fluid.

15. A centralizer as recited in claim 11, further comprising a lock for retaining said contact arm in a selected orientation following radial outward movement of said contact arm.

16. A centralizer as recited in claim 15, wherein said lock is capable of retaining said contact arm in different orientations radially outwardly from said body.

17. A centralizer as recited in claim 15, wherein said lock is capable of sequential operation to retain said contact arm in orientations successively further radially outward from said body.

* * * * *